US009682797B2

(12) United States Patent
Dabbur

(10) Patent No.: US 9,682,797 B2
(45) Date of Patent: Jun. 20, 2017

(54) SAFETY MECHANISM FOR CONTAINERS

(71) Applicants: Ismail Omar Dabbur, Jaffa of Nazareth (IL); Dov Barkay, Ramat Ishay (IL)

(72) Inventor: Ismail Omar Dabbur, Jaffa of Nazareth (IL)

(73) Assignee: SEALTAP GMBH, Zug (CH)

( * ) Notice: Subject to any disclaimer, the term of this patent is extended or adjusted under 35 U.S.C. 154(b) by 0 days.

(21) Appl. No.: 14/623,742

(22) Filed: Feb. 17, 2015

(65) Prior Publication Data

US 2016/0236838 A1 Aug. 18, 2016

(51) Int. Cl.
*B65D 47/08* (2006.01)
*B65D 17/00* (2006.01)
(Continued)

(52) U.S. Cl.
CPC ..... *B65D 17/161* (2013.01); *B65D 17/165* (2013.01); *B65D 17/502* (2013.01); *B65D 43/02* (2013.01); *B65D 43/0235* (2013.01); *B65D 43/20* (2013.01); *B65D 51/18* (2013.01); *B65D 2251/009* (2013.01); *B65D 2251/0018* (2013.01); *B65D 2251/0028* (2013.01); *B65D 2251/0081* (2013.01);
(Continued)

(58) Field of Classification Search
CPC ..... B65D 43/0234; B65D 2251/0081; B65D 2251/0028; B65D 2251/009; B65D 43/0235; B65D 43/02; B65D 43/20; B65D 51/18; B65D 2517/0011; B65D 2517/0014; B65D 2517/0062
USPC ..... 220/254.1, 254.9, 269
See application file for complete search history.

(56) References Cited

U.S. PATENT DOCUMENTS 581,293 A * 4/1897 Leggett ..... B65D 47/286 220/254.9
4,170,724 A * 10/1979 Waterbury ..... B65D 17/506 206/807
(Continued)

FOREIGN PATENT DOCUMENTS

CN 203682067 U 7/2014
ES 1046776 Y 7/2001
(Continued)

*Primary Examiner* — Fenn Mathew
*Assistant Examiner* — Elizabeth Volz
(74) *Attorney, Agent, or Firm* — Browdy and Neimark, P.L.L.C.

(57) ABSTRACT

Safety cover mechanism for a container that comprises: a sealer; tracks positionable over the upper surface of the container; and a shutter member slidable over the tracks such as to allow covering and revealing the opening by sliding the shutter member over the tracks. The safety cover mechanism is configured such that sliding of the shutter member over the tracks away from the location of the opening of the container causes at least a portion of the sealer to unseal the opening thereby indicating that the container has been opened.

A safety mechanism for containers with a pull or a stay-on tab and a press button sealer, where the tab pivotally connects to the container upper surface via a connecting element, wherein the safety mechanism is configured to prevent rotation of the tab over the axis of the connecting element for preventing unauthorized penetration to the container.

13 Claims, 12 Drawing Sheets

(51) Int. Cl.

| | |
|---|---|
| ***B65D 17/50*** | (2006.01) |
| *B65D 43/20* | (2006.01) |
| *B65D 43/02* | (2006.01) |
| *B65D 51/18* | (2006.01) |

(52) U.S. Cl.
CPC *B65D 2517/004* (2013.01); *B65D 2517/0011* (2013.01); *B65D 2517/0014* (2013.01); *B65D 2517/0062* (2013.01)

(56) References Cited

U.S. PATENT DOCUMENTS

| | | | | | |
|---|---|---|---|---|---|
| 4,214,672 | A | | 7/1980 | Peniche | |
| 4,537,326 | A | | 8/1985 | Morehead | |
| 4,989,746 | A | * | 2/1991 | Pierce | B65D 51/007 220/254.3 |
| 5,285,924 | A | | 2/1994 | Morris | |
| 5,299,604 | A | * | 4/1994 | Pierce | B65D 17/166 141/165 |
| 5,462,189 | A | * | 10/1995 | Pierce | B65D 17/166 220/815 |
| 7,025,224 | B2 | | 4/2006 | Coleman | |
| 7,222,746 | B2 | | 5/2007 | Eckstrum | |
| 2014/0312038 | A1 | * | 10/2014 | van Alfen | B65D 47/0804 220/214 |

FOREIGN PATENT DOCUMENTS

| | | | |
|---|---|---|---|
| JP | 6219448 | A | 8/1994 |
| JP | 7132937 | A | 5/1995 |
| JP | 2002104472 | A | 4/2002 |
| WO | 2013062062 | A1 | 5/2013 |
| WO | 2013124019 | A2 | 8/2013 |

* cited by examiner

SAFETY MECHANISM FOR CONTAINERS

FIELD OF THE INVENTION

The present invention generally relates to mechanisms for sealing containers and more particularly to mechanisms for safety sealing and covering of containers allowing repeatable covering and opening of a container's opening especially yet not exclusively for food and beverages containers.

BACKGROUND OF THE INVENTION

Manufacturers of food and beverages cans typically use pull-tab sealing and opening mechanism or stay-on tabs, in which a tab is used to tear off the can upper face (full aperture end) or designated part thereof for leaving an opening at the can upper face. In the pull tab mechanism the tab is removed from the can whereas in the stay-on tab the tab remains after the opening is revealed.

Other solutions involve press button mechanisms, in which a designated opening in the can upper face is sealed by using soft connection of the sealer to the opening rim requiring pressing the softly connected seal downwards towards the inner space of the can for opening thereof.

These solutions are vulnerable to unauthorized penetration to the inner cavity of the containers after filling and sealing thereof by the manufacturer and enable insertion of materials into the containers while covering any trace of the penetration. For example, in the case of the pull-tab or stay-on tab sealing the tab connects to the upper surface of the can container usually through a connecting stud and can be easily rotated around the stud axis revealing some of the upper surface exposed for injecting a material into the can or even replacing the liquid in the can with a different liquid and covering the area of the penetration hole by rotating the tab back to its position again. In this way the user of the can cannot see that the can was "treated" and might innocently use it for drinking or for eating food content thereof.

SUMMARY OF THE INVENTION

According to one aspect of the invention, there is provided a safety cover mechanism for a container having an upper surface with an opening thereover, wherein the safety cover mechanism comprises: (a) a sealer configured for sealing the opening of the container; (b) at least one track positionable over the upper surface of the container in proximity to the opening thereof; and (c) a shutter member slidable over the at least one track such as to allow covering and revealing the opening by sliding the shutter member over the at least one track, wherein the shutter member and tracks are positioned and configured such that sliding of the shutter member over the at least one track away from the location of the opening of the container causes at least a portion of the sealer to unseal the opening thereby indicating that the container has been opened.

Optionally, the safety cover mechanism comprises two tracks.

According to some embodiments, the one or more tracks are formed in the manufacturing process of the container by punch pressing of the upper surface of the container.

According to other embodiments, the at least one track protrudes from the upper surface of the container.

The shutter member optionally comprises at least one protrusion thereover for easy sliding thereof through the tracks.

In some embodiments, the safety cover mechanism further comprises at least one stopper for limiting sliding movement of the shutter member e.g. for preventing the shutter from exceeding one or both edges of the at least one track.

According to some embodiments, the stopper includes a recess formed over the upper surface of the container. In other embodiments, one or more edges of each of the one or more tracks is curved.

The sealer may be one of: a press button sealer configured for sealing the opening of the container by soft connecting to the edges of the opening; or a flexible sealer configured to seal the opening of the container by covering thereof, the flexible sealer is further configured to cover a rim portion of the container designed to be in contact with lips of a user for beverages can type containers.

Optionally, the shutter member comprises a folded edge part, which is folded inwardly towards the upper surface of the container such as to press downwardly at least part of the sealer of the safety cover mechanism.

Optionally, the flexible sealer is held by the at least one track.

According to some embodiments, the shutter member comprises an elevated niche fit to interlock with a protrusion of the sealer when the sealer is in its un-open position before opening of the container.

According to other aspects of the invention, there is provided a container with a safety cover mechanism the container comprises: (a) a container body having an upper surface with an opening; (b) a sealer configured for sealing the opening of the container; (c) at least one track positionable over the upper surface of the container in proximity to the opening thereof; and (d) a shutter member slidable over the at least one track such as to allow covering and revealing the opening by sliding the shutter member over the at least one track, wherein the shutter member and tracks are positioned and configured such that sliding of the shutter member over the at least one track away from the location of the opening of the container causes at least a portion of the sealer to unseal the opening thereby indicating that the container has been opened.

According to different aspects of the invention, there is provided a safety mechanism for containers with a pull tab or a stay-on tab and a press button sealer, wherein the tab pivotally connects to an upper surface of the container via a connecting element, the safety mechanism being configured to prevent rotation of the pull or stay-on tab of the container over the axis of the connecting element for preventing unauthorized access to the inner cavity of the container while the sealer thereof is maintained unopened, the safety mechanism being located over an upper surface of the container.

In some embodiments, the safety mechanism comprises at least two protruding stoppers, protruding from the upper surface of the container, wherein the protruding stoppers are located at opposite sides of the tab such as to prevent rotation thereof.

In other embodiments, the safety mechanism comprises at least one pin connecting the tab to the upper surface of the can, the pin requires pulling thereof in any attempt to pull the tab.

In other embodiments, the safety mechanism comprises at least one fastener being configured for fastening the tab to the upper surface of the container to prevent rotation of the tab.

BRIEF DESCRIPTION OF THE DRAWINGS

FIG. 1A shows a perspective view of the can having a press button sealer and the tracks of the safety cover mechanism formed by punch pressing of the upper surface part of the can; FIG. 1B shows a perspective view of the can and the shutter member of the safety cover mechanism in a closed position in which the shutter covers the press button of the can; FIG. 1C shows a perspective view of the can and safety cover mechanism, wherein the shutter member is in a semi-closed position slightly pushing the press button inwardly towards the inner cavity of the can for detaching part thereof to allow opening thereof; FIG. 1D shows a perspective view of the can and safety cover mechanism, wherein the shutter member is in a semi-closed position further pushing the press button inwardly towards the inner cavity of the can for detaching part thereof to allow opening thereof; FIG. 1E shows a perspective view of the can and safety cover mechanism, wherein the shutter member is in an open position in which the press button of the can is completely pressed inwardly leaving an open hole at the can upper face; and FIG. 1F shows a cross sectional view of the upper part of the can with the shutter member shown inside the tracks of the safety cover mechanism.

FIG. 2A shows a perspective view of the can and safety cover mechanism, in which the shutter member and the flexible sealer are in a sealed closed position covering the press button that seals the opening of the can; FIG. 2B shows a perspective view of the can and the safety cover mechanism, wherein the shutter member is slid backwards to reveal the flexible sealer and the flexible sealer is in a covering position in which it covers the can top rim part; FIG. 2C shows a perspective view of the can and the safety cover mechanism, wherein the shutter member is in an open position and the flexible sealer is slightly lifted revealing that the press button of the can is fully pushed inwardly opening the can top hole; FIG. 2D shows a perspective view of the can and the safety cover mechanism, wherein the shutter member is in a fully open position and the flexible sealer is fully removed; and FIG. 2E shows a cross sectional view of the upper part of the can with the shutter member shown inside the tracks of the safety cover mechanism.

FIG. 3A shows a perspective view of the can and safety cover mechanism, in which the shutter member is in a closed position covering the press button sealer that seals the opening of the can; FIG. 3B shows a perspective view of the can and the safety cover mechanism, wherein the shutter member is in a semi-open position slightly pushing the press button sealer inwardly into the can; FIG. 3C shows a perspective view of the can and the safety cover mechanism, wherein the shutter member is in a fully open position and the press button is fully inserted into the can or dropped therein; FIG. 3D shows a perspective view of the shutter member of the safety cover mechanism; and FIG. 3E shows a cross sectional view of the upper part of the can with the shutter member shown inside the tracks of the safety cover mechanism.

FIG. 4A shows a perspective view of the can and safety cover mechanism, in which the shutter member and flexible sealer are in closed position; FIG. 4B shows a perspective view of the can and the safety cover mechanism wherein the shutter member is in an open position and the flexible sealer is in a closed position; FIG. 4C shows a perspective view of the can and the safety cover mechanism, wherein the shutter member is in an open position and the flexible sealer is slightly lifted to remove thereof for using the can for drinking therefrom; FIG. 4D shows a perspective view of the can and the safety cover mechanism, wherein the shutter member is in a fully open position and the flexible sealer is fully removed; and FIG. 4E shows a cross sectional view of the upper part of the can with the shutter member shown inside the tracks of the safety cover mechanism.

FIG. 5A shows a perspective view of the can and safety cover mechanism, wherein the tracks of the safety cover mechanism protrude from the upper surface part of the can; FIG. 5B shows a perspective view of the can and the flexible sealer of the safety cover mechanism in a closed position in which the flexible sealer seals the opening of the can and covers a rim portion thereof designated to be in contact with a user's lips from drinking beverage content of the can; FIG. 5C shows a perspective view of the can and safety cover mechanism, wherein the shutter member is in a semi-closed position slightly tearing off a softly connected sealing part of the flexible sealer; FIG. 5D shows a perspective view of the can and safety cover mechanism, wherein the shutter member is in a fully open position revealing the sealing opening of the flexible sealer while maintaining part of the sealer over the can rim portion that is to be in contact with the user's lips; FIG. 5E shows a perspective view of the can and safety cover mechanism, wherein the shutter member is in an open position and the flexible sealer is semi-removed at least from the rim portion it covered; FIG. 5F shows a perspective view of the can and safety cover mechanism in a fully open position with the flexible sealer fully removed therefrom; and FIG. 5G shows a cross sectional view of the upper part of the can with the shutter member shown inside the tracks of the safety cover mechanism.

FIG. 6A shows a top view of the can and safety mechanism; FIG. 6B shows a cross sectional side view of the can and safety mechanism; and FIG. 6C shows a perspective view of the can and safety mechanism.

DETAILED DESCRIPTION OF SOME EMBODIMENTS OF THE INVENTION

Figure 1A:
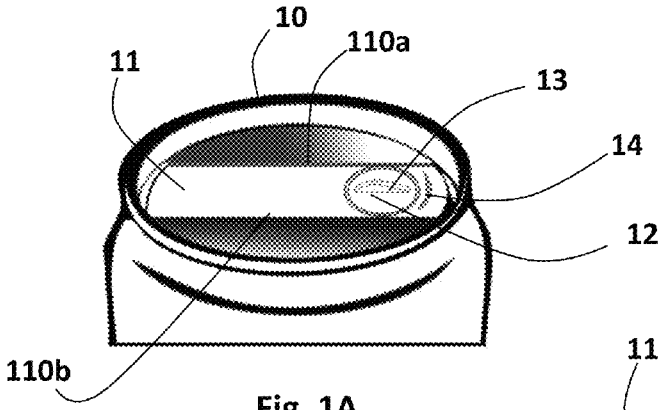
FIGS. 1A-1F schematically illustrate a safety cover mechanism for a conical can container having a press button sealer, wherein the safety cover mechanism has a shutter member slidable over designated tracks, according to some embodiments of the present invention.
Figure 1B:
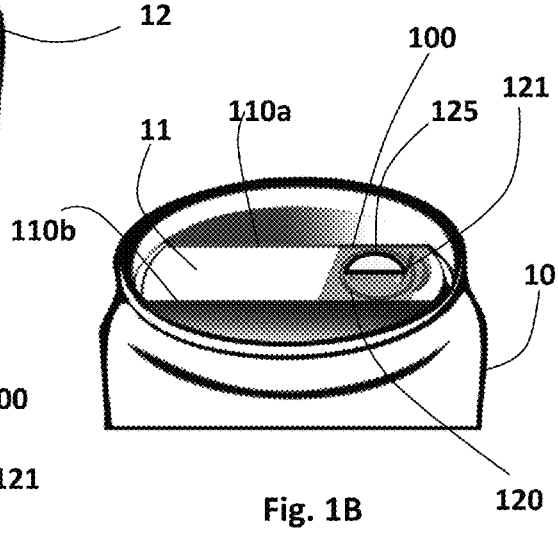
Figure 1C:
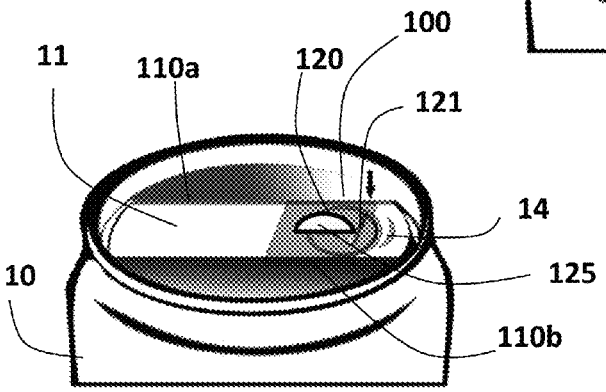
Figure 1D:
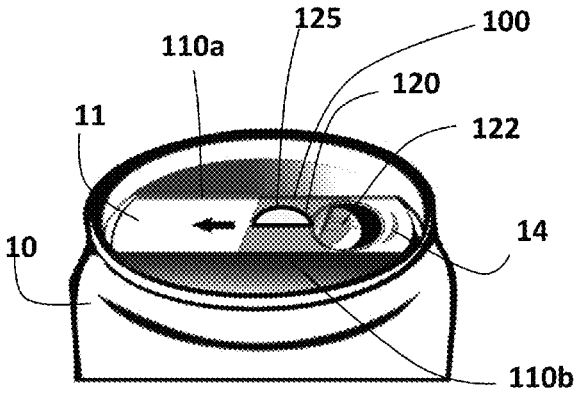

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides a safety cover mechanism for containers such as food or beverages cans or any other container. The safety cover mechanism is designed to prevent unauthorized and unnoticed penetration to the inner cavity of the container by only enabling accessing the content of the container through the mechanism, which will always leave a visible trace to the opening or any other treatment thereof.

According to some embodiments, the safety cover mechanism comprises at least one track positionable over a top part of the container in proximity to an opening thereof, which may be sealed by a sealer softly connected to edges of the opening; and a shutter member slidable over the at least one track such as to allow covering and revealing the container opening by sliding the shutter member along the one or more tracks. The one or more tracks may be designed as an integral part of the container top or connected thereto. The shutter and track design does not enable any part of the upper surface of the container to be exposed and then constantly covered during opening of the container, since the shutter has to be moved along the one or more tracks for repeatedly revealing and covering the opening thereof. This leaves out the pull or stay-on tab solutions which allow some of the surface of the container to be exposed and then re-covered again for concealing the penetration hole.

In some embodiments, the shutter member also allows opening the sealer of the can top for revealing the opening thereof to allow access to the container's content, e.g. in case of beverage can container with a press button sealer the shutter is placed over the press button and when first slid back along the tracks it also presses the button inwardly into the can cavity for opening thereof by having a section that protrudes inwardly at one end thereof.

Reference is now made to FIGS. 1A-1F showing a safety cover mechanism 100 over an upper surface 11 of a can 10 container, according to one embodiment of the invention. The safety cover mechanism 100 in this embodiment includes a shutter member 120 and two tracks 110*a* and 110*b* formed by punch pressing of the upper surface 11 part of the can 10. The shutter member 120 is inserted and slid through those tracks 110*a* and 110*b* The can 10 may be made of aluminum or aluminum alloy or any other material known in the art for can production.

The can 10 has an opening 15 over its upper surface 11 sealed by a press button sealer 12, which is a piece that loosely connects to the rim of the opening 15 by a soft connection that can be easily open once applying pressure inwardly over the sealer 12.

According to some embodiments, as shown in FIGS. 1A-1E, the upper surface 11 of the can 10 may include a recess stopper 14 also formed by punch pressing, for preventing the shutter member 120 from exceeding thereof when slid through the tracks 110*a* and 110*b*.

The shutter member 120 has a protrusion 121 for comfort sliding thereof and a folded edge part 122 (see FIG. 1E) that folds inwardly towards the upper surface 11 of the can 10 for being blocked by the recess stopper 14 and also for enabling pressing the press button sealer 12 inwardly at the first opening of the can 10 when the shutter member 120 is slid thereover.

The design of the slidable shutter member 120 over the opening of 15 of the can 10 allows revealing and covering thereof at will repeatedly by sliding the shutter member 120 back and forth over the tracks 110*a* and 110*b*.

Figure 1E:
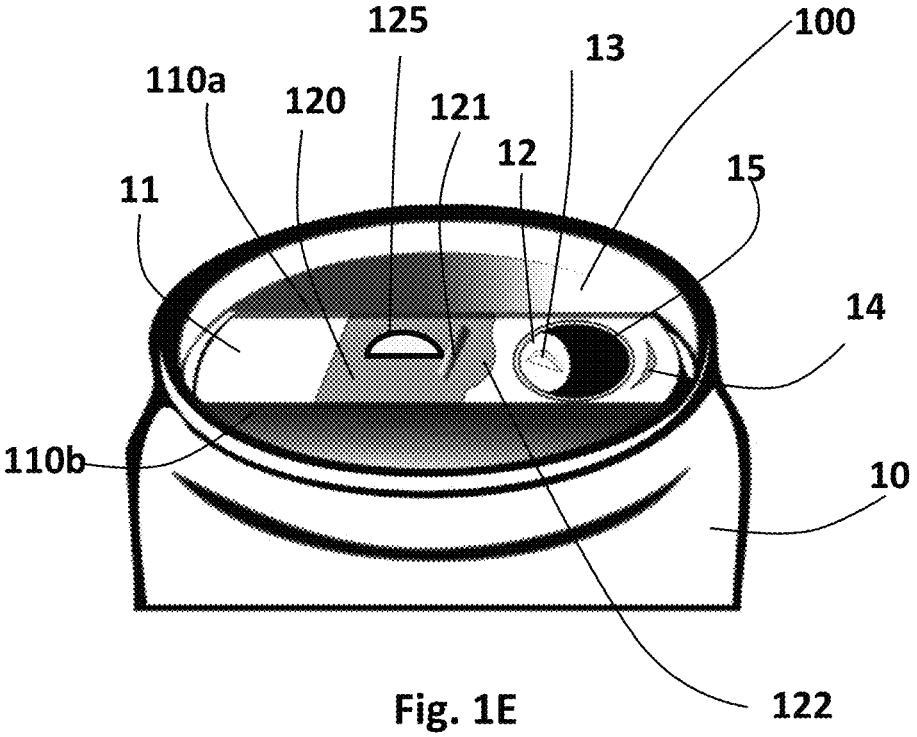

According to some embodiments, as shown in FIGS. 1A and 1E, the press button sealer 12 also has a protrusion 13 that engages the folded edge part 122 of the shutter member 120 for pressing the sealer 12 inwardly when the shutter member 120 is slide thereover. The shutter member 120 also includes an elevated niche 125 fit to interlock with the protrusion 13 when the sealer 12 is in its un-open position before opening of the can 10.

Figure 1F:
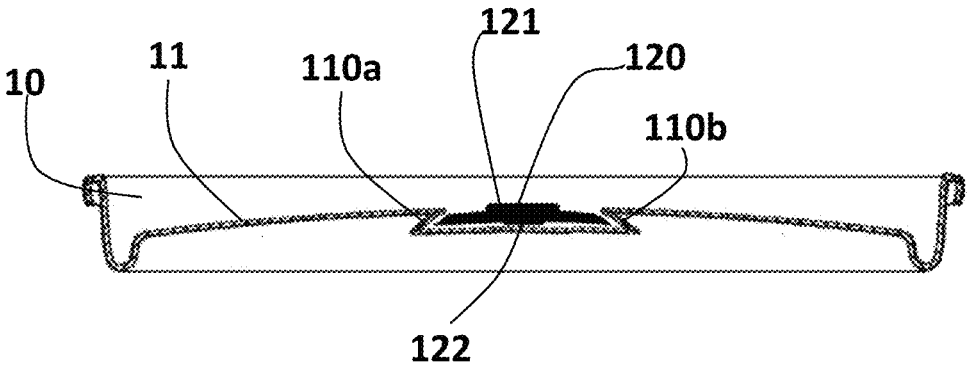

As shown in FIG. 1F, the upper surface 11 of the can 10 is convex in a substantially symmetric manner such that the highest point or area is located substantially at the center of the upper surface 11. Therefore, the tracks 110*a* and 110*b* formed over the upper surface 11 of the can 10 are also convex requiring the shutter member 120 to be configured in a corresponding curvature or be flexible enough to allow sliding thereof over the curved tracks 110*a* and 110*b*. In this way, since the opening 15 is located offset from the center of the upper surface 11, the shutter member 120 passes thereof while declining from the highest area of the upper surface 11 allowing further pressing the press button 12 inwardly thereby.

Reference is now made to FIGS. 2A-2E showing a safety cover mechanism 200 installed over an upper face 21 of a can 20 container, according to another embodiment of the invention. The safety cover mechanism 200 in this embodiment includes a shutter member 220 and two tracks 210*a* and 210*b* over which the shutter member 220 is slid. Each of the tracks 210*a* and 210*b* is either integrally or non-integrally connected over the upper surface 21 of the can 20 and may be made from any rigid or semi-rigid material known in the art such as plastic, aluminum, alloy and the like. The can 20 may be made of aluminum or aluminum alloy or any other material known in the art for can production. The shutter member 220 has a protrusion 221 for comfort sliding thereof.

Figure 2A:
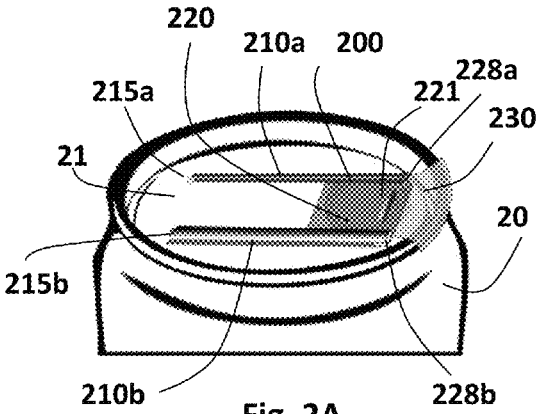
FIGS. 2A-2E schematically illustrate a safety cover mechanism for a conical can container, wherein the safety cover mechanism has a shutter member slidable over protruding tracks and a flexible sealer for sealing an opening of the can and for covering part of the can top rim that is designated for contacting the mouth of a person drinking from the can for improving hygiene, according to other embodiments of the present invention.
Figure 2B:
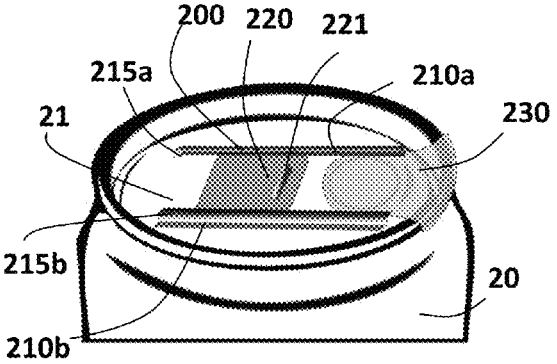
Figure 2C:
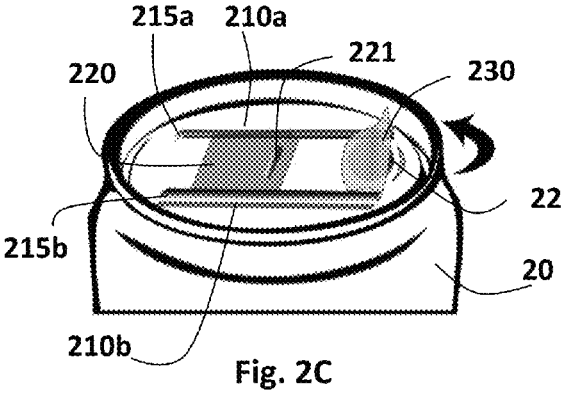
Figure 2D:
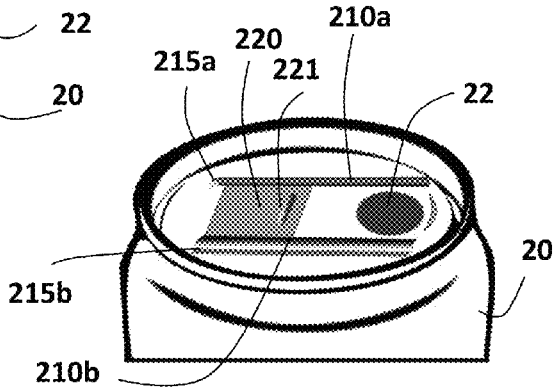

As shown in FIGS. 2A-2C, the safety cover mechanism 200 further includes a flexible sealer 230 that is attached or placed between the opening 22 of the can 20 and the shutter member 220 and serves as a sealer for the can 20 opening 22. The flexible sealer 230 is designed to cover a portion of the top rim of the can 20 that would contact the user's mouth when drinking from the can 20. Before the first opening of the can 20 the shutter member 220 is slid backwards towards the distal rim of the can top in respect to the opening thereof and thereby also pulls the flexible sealer 230 to reveal the opening 22 flexible sealer of the can 20. Once the shutter member 220 is in a fully open position and the opening 22 is fully revealed (see FIG. 2D) the flexible sealer 230 can be removed by pulling thereof leaving only the shutter member 220 and tracks 210*a* and 210*b* over the can top side 21 for repeatable covering and revealing of the opening 22 (see FIG. 2D). Alternatively, the flexible sealer 230 is remained attached at one end thereof to the upper surface 21 of the can 20 for re-sealing of the opening 22 upon covering thereof by the shutter member 220.

The shutter member 220 has no inwardly folded portion at its edge in this embodiment and the tracks 210*a* and 210*b* edges 215*a* and 215*b* are inwardly curved to serve as stoppers for preventing the shutter member 220 from exceeding thereof when slid backwards.

Figure 2E:
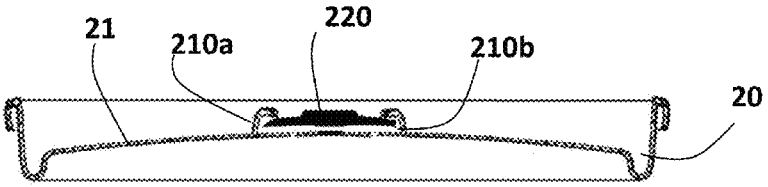

As shown in FIG. 2E, the upper surface 21 of the can 20 is convex in a substantially symmetric manner such that the highest point or area is located substantially at the center of the upper surface 21. Therefore, the tracks 210*a* and 210*b* formed over the upper surface 21 of the can 20 are also convex requiring the shutter member 220 to be configured in a corresponding curvature or be flexible enough to allow sliding thereof over the curved tracks 210*a* and 210*b*.

As shown in FIG. 2A, the safety cover mechanism 200 may also include frontal shutter stoppers such as stoppers 228*a* and 228*b* loosely attached to the shutter member 220 and covering the edges of the tracks 110*a* and 110*b*. Any slight sliding movement of the shutter member 220 backwards will cause these stoppers 228*a* and 228*b* to tear their loose holding to the shutter member 220 since they block the backwards movement thereof and since they are loosely connected thereto. This will allow identification of the sliding of the shutter member 220 for security purposes.

Reference is now made to FIGS. 3A-3F showing a safety cover mechanism 300 installed over an upper face 31 of a can 30 container, according to yet another embodiment of the invention. The safety cover mechanism in this embodiment includes a shutter member 320 and two protruding tracks 310*a* and 310*b* over which the shutter member 320 is slidable. Each of the tracks 310*a* and 310*b* connects to a rim part of the can upper surface 31. The can 30 may be made of aluminum or aluminum alloy or any other material known in the art for can production. The can 30 has an opening over its upper face 31 sealed by a press button sealer 32.

According to some embodiments, as shown in FIGS. 3A-3D, the upper face 31 of the can 30 may include a recess stopper 34 for preventing the shutter member 320 from exceeding thereof.

The shutter member 320 has a protrusion 321 for comfort sliding thereof and a folded edge part 323 (see FIG. 3D) that folds inwardly towards the upper face 31 of the can 30 for enabling pressing the press button sealer 32 inwardly at the first opening of the can 30.

Figure 3A:
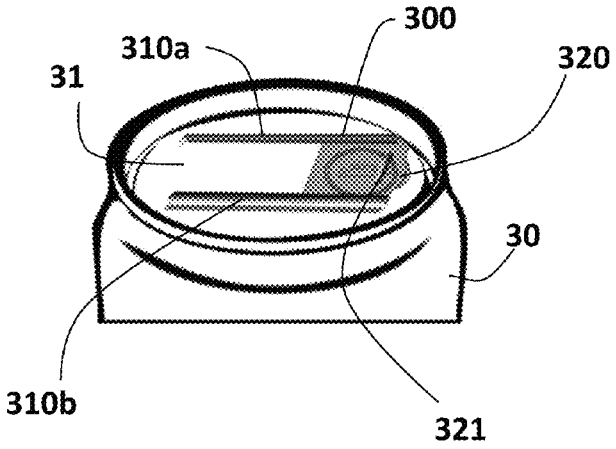
FIGS. 3A-3E schematically illustrate a safety cover mechanism for a conical can container having a press button sealer, wherein the safety cover mechanism has a shutter member slidable over protruding tracks, according to other embodiments of the present invention.
Figure 3B:
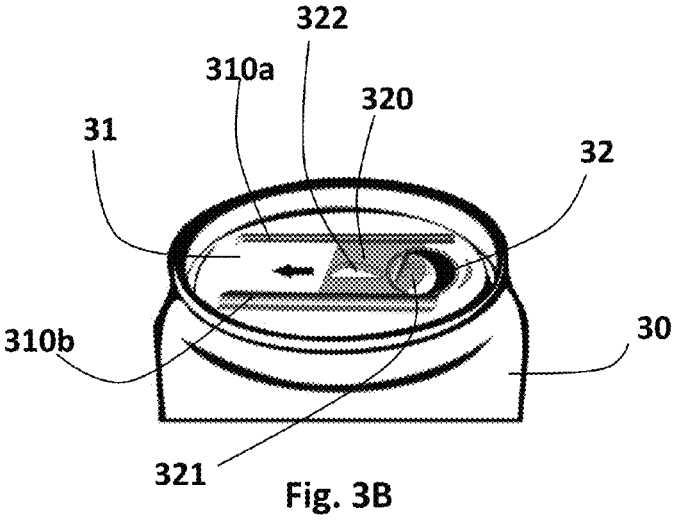
Figure 3C:
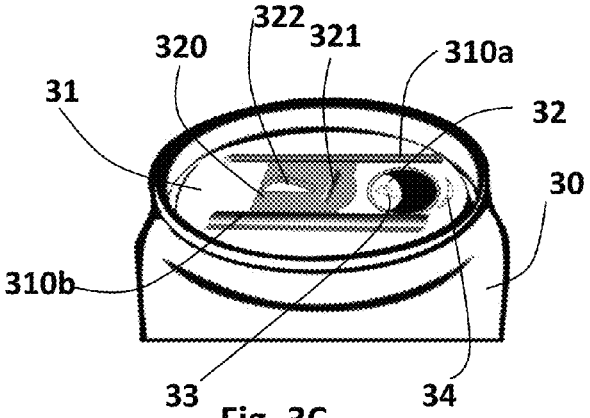
Figure 3D:
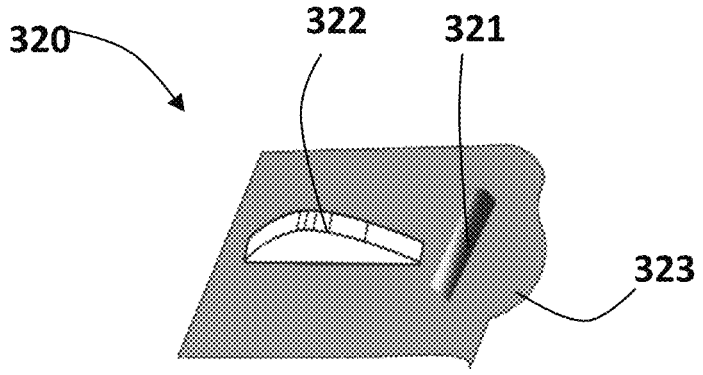

According to some embodiments, as shown in FIGS. 3A-3B, the press button sealer 32 also has a protrusion 33 that engages the folded edge part 323 of the shutter member 320 for allowing the folded edge part 323 to engage the protrusion 33 for pressing the sealer 32 inwardly towards the can 30 inner cavity.

Additionally, as shown in FIGS. 3A-3D, the shutter member 320 upper surface connects to an elevated niche 322 configured to interlock with the protrusion 33 of the press button sealer 32 when in its pre-open position before first opening of the can 30.

Figure 3E:
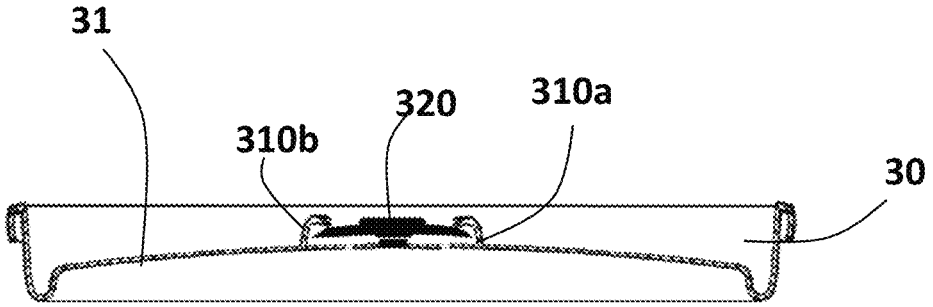

As shown in FIG. 3E, the upper surface 31 of the can 30 is convex in a substantially symmetric manner such that the highest point or area is located substantially at the center of the upper surface 31. Therefore, the tracks 310*a* and 310*b* formed over the upper surface 31 of the can 30 are also convex requiring the shutter member 320 to be configured in a corresponding curvature or be flexible enough to allow sliding thereof over the curved tracks 310*a* and 310*b*.

Reference is now made to FIGS. 4A-4E showing a safety cover mechanism installed over an upper face 41 of a can 40 container, according to yet another embodiment of the invention. The safety cover mechanism 400 in this embodiment includes a shutter member 420, a flexible sealer 430 and two tracks 410*a* and 410*b* formed by punch pressing of the upper surface 41 part of the can 40.

The can 40 has an opening 42 over its upper surface 41 sealable by the flexible sealer 430 of the safety cover mechanism 400.

The shutter member 420 has a protrusion 421 for comfort sliding thereof.

Figure 4A:
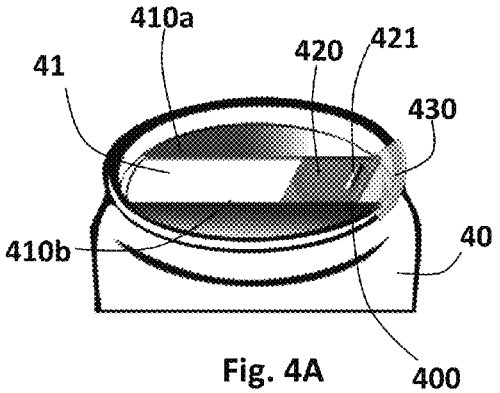
FIGS. 4A-4E schematically illustrate a safety cover mechanism for a conical can container, wherein the safety cover mechanism has a shutter member slidable over tracks formed over the can upper face and a flexible sealer for sealing an opening of the can and for covering part of the can top rim that is designated for contacting the mouth of a person drinking from the can for improving hygiene, according to other embodiments of the present invention.
Figure 4B:
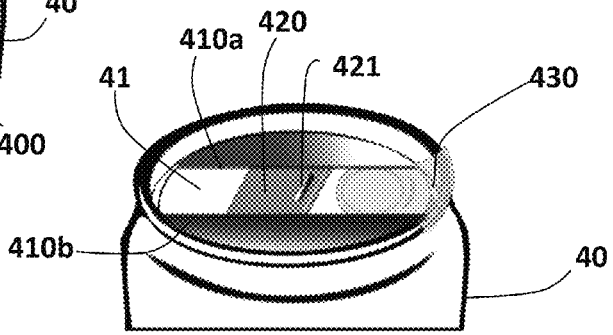
Figure 4C:
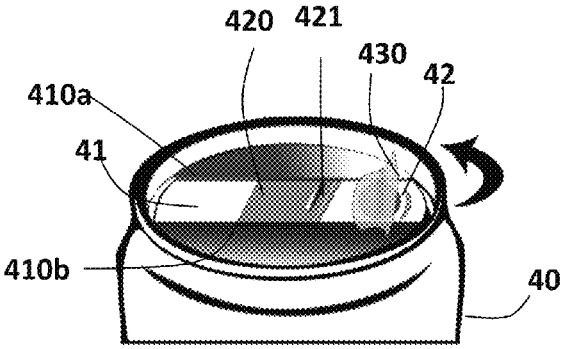
Figure 4D:
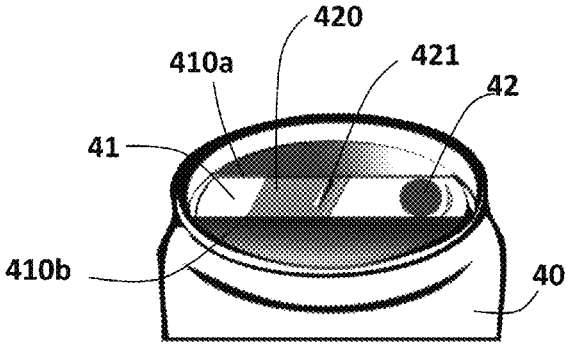
Figure 4E:
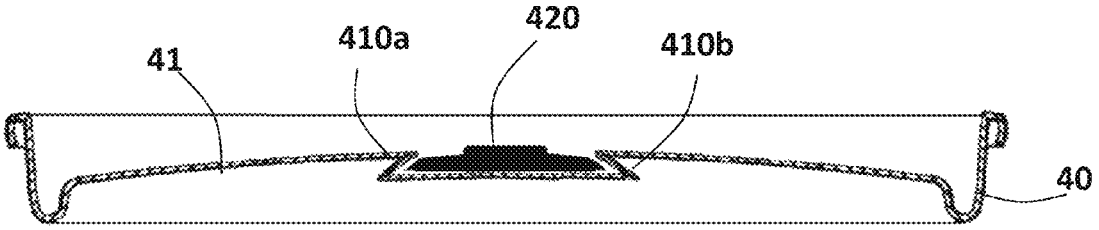

As shown in FIGS. 4A-4C, the flexible sealer 430 is attached or placed between the opening 42 of the can 40 and the shutter member 420 and serves as a sealer of the opening 42 as well as a hygiene element for preventing exposure of the part of the can 40 rim that is designated to be in contact with a user's lips during storage and transport of the can 40. The flexible sealer 430 is removable from that rim part of the can 40 only upon first opening thereof and can then be either completely removed from the can 40 or reused for re-sealing of the can opening 42 by connecting still to the can surface 41 at one end thereof.

Reference is now made to FIGS. 5A-5G, schematically illustrating a safety cover mechanism 500, according to another embodiment of the invention. In this embodiment the safety cover mechanism 500 includes a shutter member 520, two protruding tracks 510*a* and 510*b* located over the upper surface 51 of a beverage can 50 and a flexible sealer 530 having a designated sealing portion 531 that loosely connects thereto for easy opening thereof, when the shutter member 520 is slid over the tracks 510*a* and 510*b*. The tracks 510*a* and 510*b* have curved edges 515*a* and 515*b* serving as stoppers for preventing the shutter member 520 from exceeding thereof when slid opposite to the can opening 54.

Figure 5A:
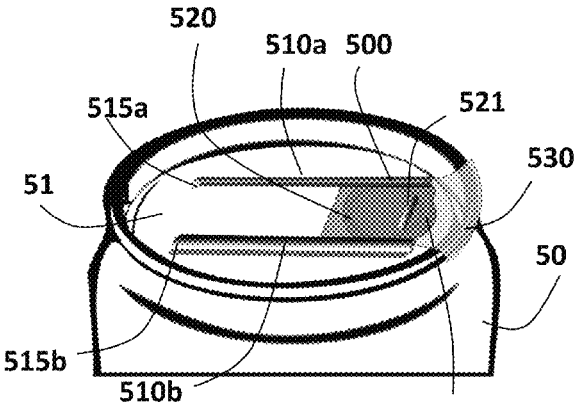
FIGS. 5A-5G schematically illustrate a safety cover mechanism for a conical can container having a flexible sealer, wherein the safety cover mechanism has a shutter member slidable over designated tracks, according to some embodiments of the present invention.
Figure 5B:
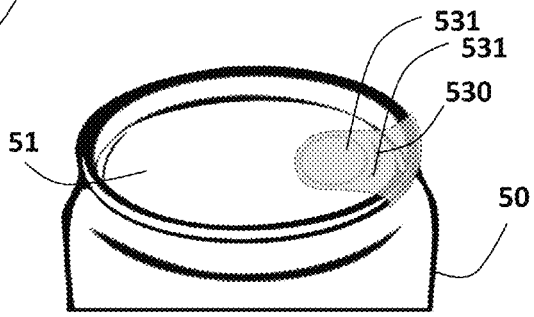
Figure 5C:
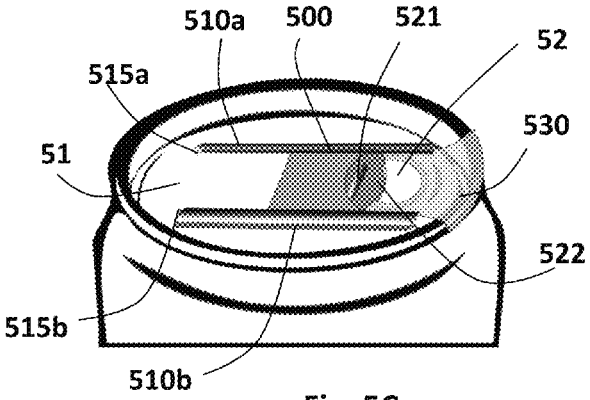
Figure 5D:
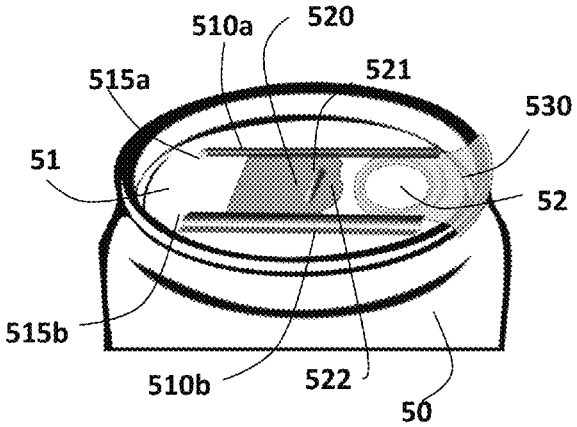
Figure 5E:
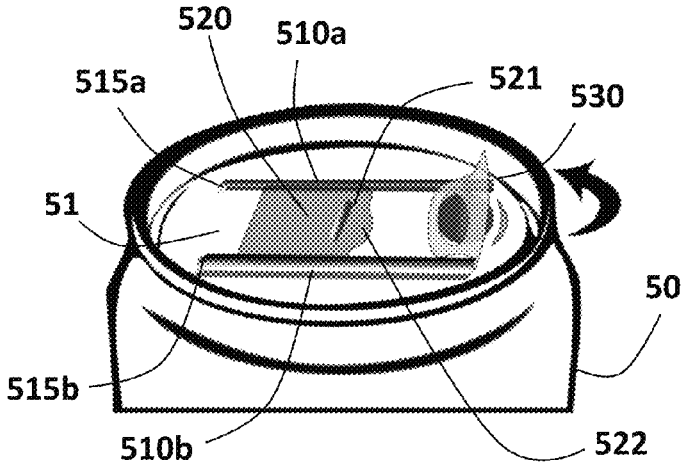
Figure 5F:
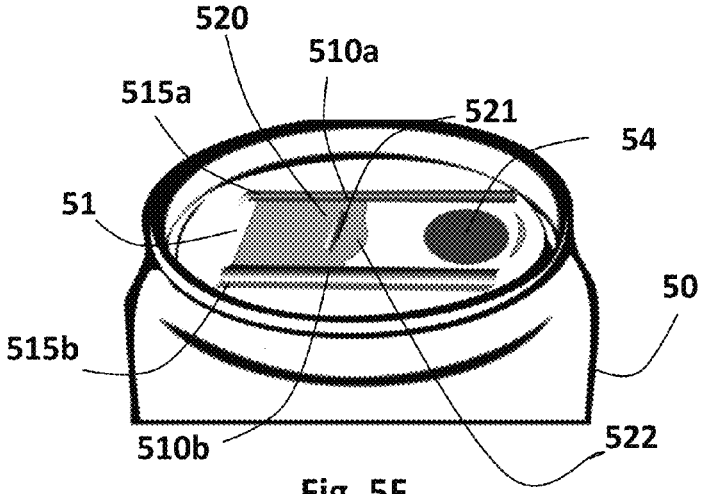
Figure 5G:
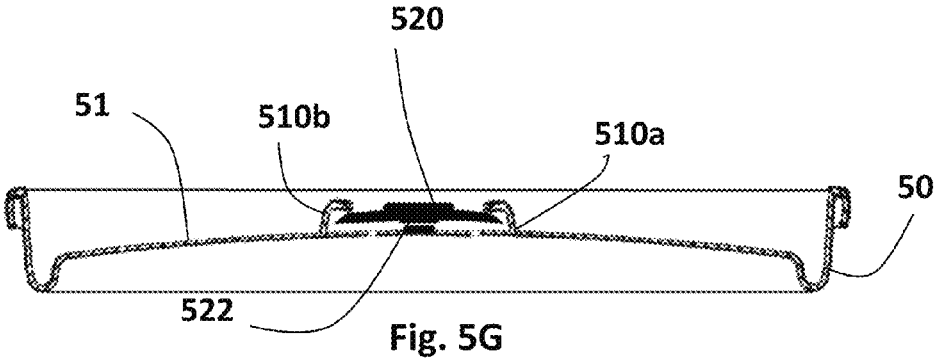

According to some embodiments, the flexible sealer 530 covers a rim portion of the can 50 designated to be in contact with a user's lips when drinking for hygienic purposes. Additionally, as shown in FIGS. 5C-5D, once the shutter member 520 is slid backwards, away from the location of the opening 54 of the can, the loosely connected portion 531 of the flexible sealer 530 tears due to the pressure applied thereover by an inwardly protruding folded edge 522 of the shutter member 520. The shutter member 520 may also include a protrusion 521 for easy sliding thereof.

The safety cover mechanism as described above or in any other embodiment of this invention is designed such that when the shutter member is even slightly slid away from the location of the opening of the container in the first opening of the container this slight sliding movement thereof will cause the sealer (either the press button sealer, flexible sealer or any other sealer design) to be at least partially unsealed in a manner that will not allow reconnecting thereof. This means that once the shutter member is slightly slid through the tracks to open, it will be indicate to the user that the can was opened after the manufacturer had sealed it at least to some extent. This configuration is targeted at preventing unauthorized penetration into the container's inner content for preventing felonious penetration of materials after the can has been sealed by the manufacturer.

According to other aspects of the invention, there is provided a safety mechanism for containers with a pull tab or a stay-on tab and a press button as an opening sealer, where the tab pivotally connects to the upper surface of the container e.g. can through a connecting element such as a stud or screw defining the tab's rotation axis. The safety mechanism comprises at least one stopper configured to prevent rotation of the pull or stay-on tab around its axis, for preventing unauthorized access to the inner cavity of the container while the sealer thereof is maintained by rotating the tab and exposing a portion of the surface that would be hidden by the tab if not rotated for penetrating into the container by punctuating the exposed portion and then hiding the penetration hole by rotating the tab back to its original position opposite the sealer.

Figure 6A:
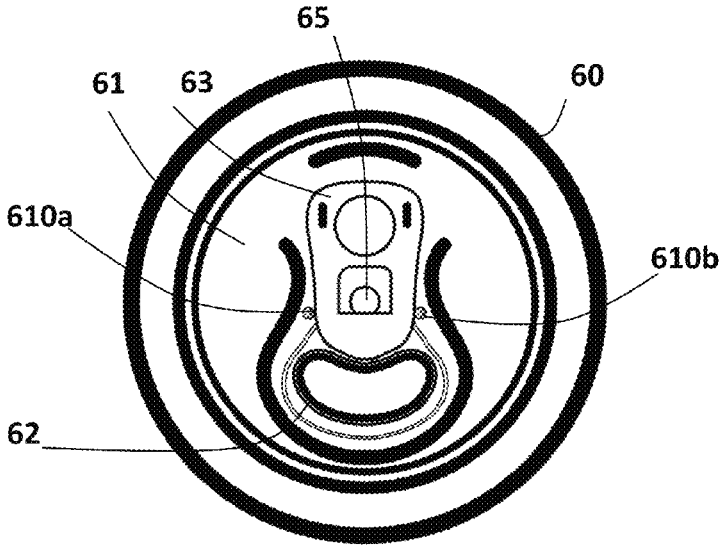
FIGS. 6A-6C show a safety mechanism for food or beverage containers such as a can, which is designed to prevent rotation of a pull or stay-on tab of the can, which includes two protrusions protruding from the can upper face and located at opposite sides of the tab, according to one embodiment of the invention.
Figure 6B:
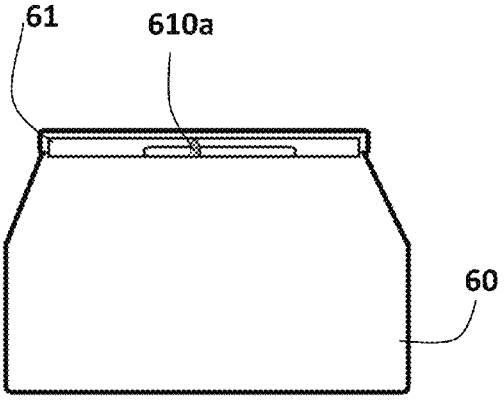
Figure 6C:
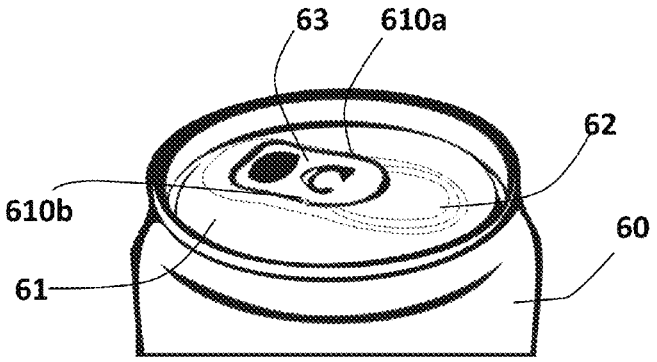

Reference is now made to FIGS. 6A-6C showing a safety mechanism for a stay-on tab closure of a can container 60, according to some embodiments. The stay-on tab closure includes a stay-on tab 63 and press button sealer 62 for sealing an opening at the upper part 61 of the can 60. The closure mechanism is stay-on tab 63 connects to the upper part 61 of the can 60 via a connecting stud or screw connector 65. The safety mechanism includes two stoppers 610*a* and 610*b*, which protrude from the upper part 61 cover of the can 60 configured as integral part of the can upper part 61 or attached thereto.

These two stoppers 610*a* and 610*b* are positioned adjacent to sides of the stay-on tab 63 to prevent rotation of the tab 63 thereby preventing unauthorized accessing the inner cavity of the can 60 by attempting to punctuate a surface of the upper part 61 that is adjacent to the connector 65.

Figure 7:
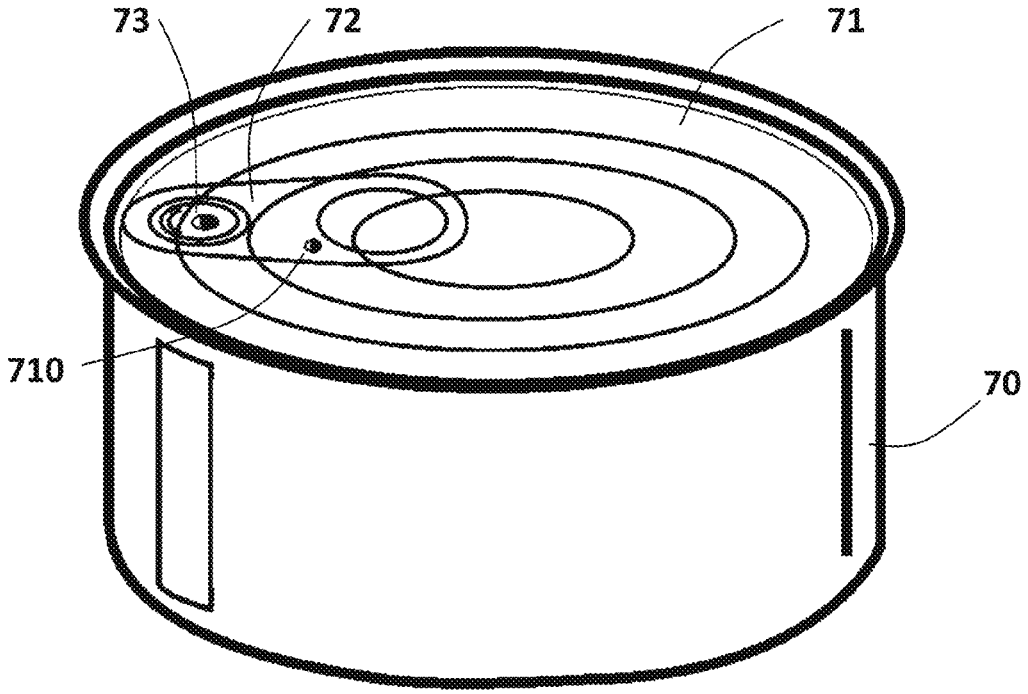
FIG. 7 shows a safety mechanism for preventing rotation of a pull tab of a can, which includes a single pin fastening the tab to the upper face part of the can, according to an alternative embodiment of the invention.

FIG. 7 shows a safety mechanism for preventing rotation of a pull tab 72 for pulling an upper face 71 of a can 70, pivotally connecting to the upper surface 71 via a stud connecting element 73. The safety mechanism includes a pin 710 located over the pull tab 72 protruding inwardly penetrating the upper surface 71 of the can 70 for connecting the pull tab 72 to the upper surface 71, according to an alternative embodiment of the invention. The connecting pin 710 is located offset from the rotation axis of the tab 72 defined by the connecting stud 73.

Figure 8:
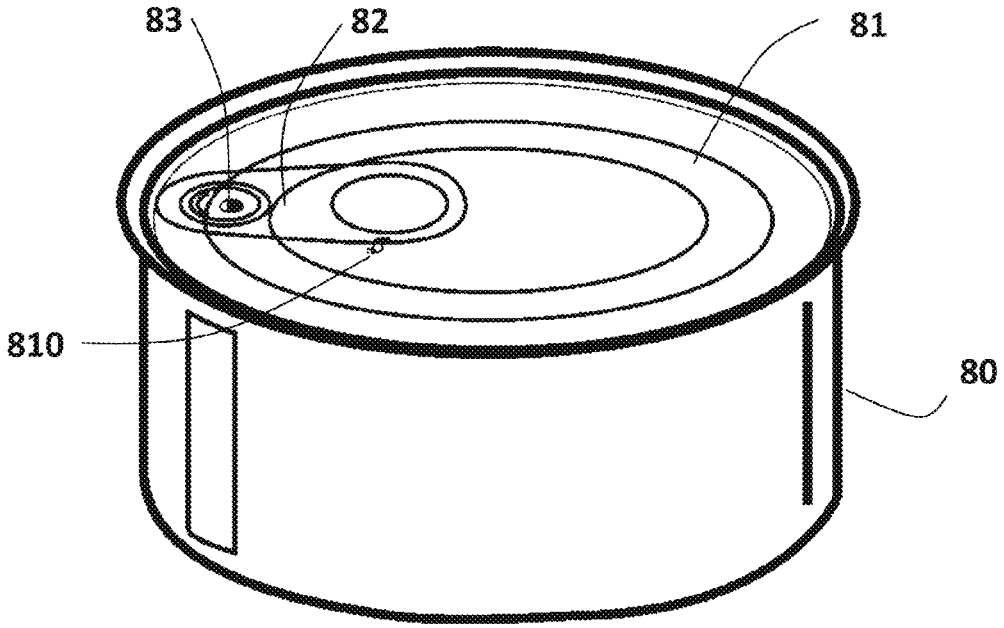
FIG. 8 shows a safety mechanism for preventing rotation of a pull tab of a can, which includes a fastener fastening the pull tab and the cover of the can, according to another embodiment of the invention.

FIG. 8 shows a safety mechanism for preventing rotation of a pull tab 82 for pulling an upper face 81 of a can 80 connected to the cover 81 via a connector 83, wherein the safety mechanism includes a fastener 810 fastening the pull tab 82 to the cover 81 of the can 80 to prevent rotation of the pull tab 82, according to another embodiment of the invention.

Figure 9:
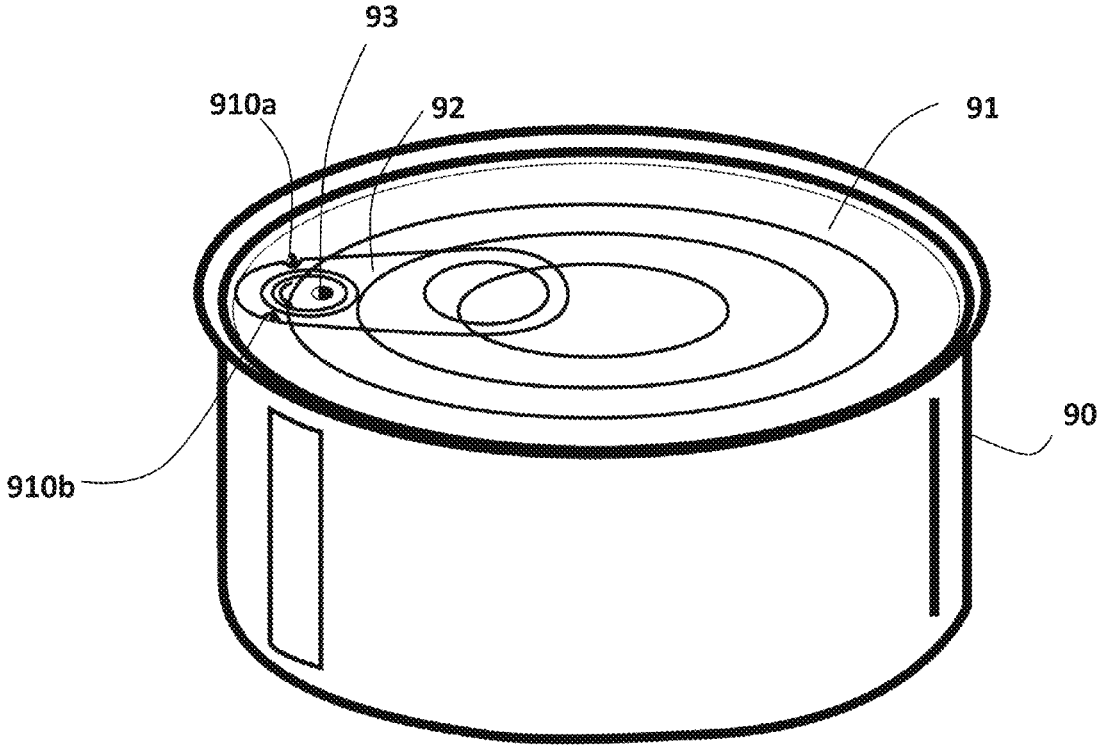
FIG. 9 shows a safety mechanism for preventing rotation of a pull tab of a can, which includes two protrusions, located at opposite sides of the pull tab, according to yet another embodiment of the invention.

FIG. 9 shows a safety mechanism for preventing rotation of a pull tab 92 for pulling an upper face 91 of a can 90 connected to the cover 91 via a connector 93, wherein the safety mechanism includes two protrusions 910*a* and 910*b* located adjacent to the pull tab 92 adjacent to opposite sides thereof for preventing rotation of the pull tab 92, according to yet another embodiment of the invention. The protrusions 910*a* and 910*b* may be integrally connected to the can upper face 91 or separately connected thereto. As shown in FIG. 8, the pull tab 82 is designed such that it has two recesses for fitting the stopper protrusions 810*a* and 810*b* therein.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A safety cover mechanism for a container having an upper surface with an opening, said safety cover mechanism comprising:

a. a sealer that seals the opening of the container, wherein the sealer is connected to a rim of the opening at the level of the upper surface and has a protrusion;

b. a track affixed to the upper surface of the container in proximity to the opening; and c. a shutter member slidable over the track, wherein the shutter member has an elevated niche which interlocks with the protrusion of the sealer, and wherein sliding of the shutter member over the track away from the opening causes the protrusion of the sealer to be depressed thereby detaching a portion of the sealer from the opening.

2. The safety cover mechanism according to claim 1, wherein the track comprises two rails.

3. The safety cover mechanism according to claim 1, wherein the track is formed by punch pressing of the upper surface of the container.

4. The safety cover mechanism according to claim 1, wherein the track protrudes from the upper surface of the container.

5. The safety cover mechanism according to claim 1, wherein the shutter member has at least one rail protrusion for easy sliding through the track.

6. The safety cover mechanism according to claim 1, further comprising at least one stopper for limiting sliding of said shutter member.

7. The safety cover mechanism of claim 6, wherein said stopper is a recess formed over the upper surface of the container.

8. The safety cover mechanism according to claim 6 wherein the at least one stopper comprises at least one front stopper loosely connected to said shutter member such that a first uncovering of the opening will cause the front stopper to tear away from the shutter member thereby indicating that the first uncovering has occurred.

9. The safety cover mechanism according to claim 1, wherein the track curves at least one edge thereof to prevent the shutter member from exceeding the track curved edge.

10. The safety cover mechanism according to claim 1, wherein the sealer covers both the opening and an edge of the container that comes in contact with a drinker's lips, for hygienically protecting the edge before use.

11. The safety cover mechanism according to claim 10, wherein the shutter member comprises a folded edge protruding down towards the upper surface of the container such that downward pressure on the shutter member tears the sealer.

12. The safety cover mechanism according to claim 10, wherein the flexible sealer is affixed to the track.

13. A container with a safety cover mechanism said container comprising:

a. a container body having an upper surface with an opening;

b. a sealer that seals the opening of the container, wherein the sealer is connected to a rim of the opening at the level of the upper surface and has a protrusion;

c. a track affixed to the upper surface of the container in proximity to the opening; and d. a shutter member slidable over the track, wherein the shutter member has an elevated niche which interlocks with the protrusion of the sealer, and wherein sliding of the shutter member over the track away from the opening causes the protrusion of the sealer to be depressed, thereby detaching a portion of the sealer from the opening.

* * * * *